US005529261A

United States Patent [19]

Iddan

[11] Patent Number: 5,529,261

[45] Date of Patent: Jun. 25, 1996

[54] MISSILE

[75] Inventor: Gabriel Iddan, Haifa, Israel

[73] Assignee: State of Israel - Ministry of Defense Armament Development Aytgiruty, Rafael, Haifa, Israel

[21] Appl. No.: 347,608

[22] Filed: Dec. 1, 1994

[30] Foreign Application Priority Data

Dec. 1, 1993 [IL] Israel ..... 107830

[51] Int. Cl.[6] ..... F41G 7/00

[52] U.S. Cl. ..... 244/3.16

[58] Field of Search ..... 244/3.16

[56] References Cited

U.S. PATENT DOCUMENTS

| | | | |
|---|---|---|---|
| 3,924,826 | 12/1975 | Reinert | 244/3.16 |
| 3,995,933 | 12/1976 | Crowhurst | 244/3.16 |
| 4,079,687 | 3/1978 | Mentcher . | |
| 4,193,567 | 3/1980 | McCarty, Jr. . | |
| 4,240,596 | 12/1980 | Winderman et al. | 244/3.16 |
| 4,291,848 | 9/1981 | Clark | 244/3.16 |
| 4,640,194 | 2/1987 | Witt et al. . | |
| 4,733,609 | 3/1988 | Goodwin et al. | 102/213 |
| 4,952,042 | 8/1990 | Pinson | 350/567 |
| 5,379,967 | 1/1995 | Shachar | 244/3.16 |

FOREIGN PATENT DOCUMENTS

| | | | |
|---|---|---|---|
| 252036 | 1/1988 | European Pat. Off. . | |
| 4155198 | 5/1992 | Japan | 244/3.16 |
| 5052497 | 3/1993 | Japan | 244/3.16 |
| 2144524 | 3/1985 | United Kingdom . | |
| 2275322 | 8/1994 | United Kingdom . | |

*Primary Examiner*—Charles T. Jordan
*Assistant Examiner*—Christopher K. Montgomery
*Attorney, Agent, or Firm*—Helfgott & Karas

[57] ABSTRACT

A missile comprising a missile body having a missile tip housing, a seeker head mounted into the missile tip housing and a positioner which selectably positions the seeker head in either an extended, seeking, position or a retracted, cruising, position.

20 Claims, 3 Drawing Sheets

MISSILE

FIELD OF THE INVENTION

The present invention relates to missiles generally and, more particularly, to missile scanner heads, also known as seeker heads.

BACKGROUND OF THE INVENTION

Missiles often employ seeker heads for navigation and/or homing and/or target detection purposes. Scanner heads generally include scanning infrared detectors, laser scanners, radars or any other known scanner, which rotate, tilt, or pivot about preselected axes in the seeker head.

Generally speaking, homing seeker heads typically operate in either of two modes. In a first mode of operation, namely a search/seek mode, the seeker head scans a wide field-of-view searching for a target. It is appreciated that to obtain a wide field-of-view, the seeker head must extend forwardly from the tip of the missile.

When a target is detected, the seeker head generally operates in a second mode of operation, namely a cruise/engage mode, wherein the missile cruises toward the target while the seeker head continuously engages the detected target. It is appreciated that the field-of-view required for the cruise/engage mode of operation is much narrower than the search/seek field-of-view.

For seeker heads which are relatively large, typically due to interior environment control of the seeker head, for example a cryogenic environment for an infrared detector, large optics and gimbals, the location of the seeker head may substantially affect the aerodynamics of the missile, particularly during high speed cruising wherein air drag is an important factor. Such undesired drag is normally higher when the seeker head extends from the tip of the missile, as in the large field-of-view scanner mentioned above.

SUMMARY OF THE INVENTION

It is, thus, an object of the present invention to provide apparatus for shifting the position of a seeker head relative to the tip of a carrier missile to which it is mounted.

In accordance with a preferred embodiment of the present invention, there is thus provided a missile comprising a missile body having a missile tip housing, a seeker head mounted into the missile tip hosing and a positioner which selectably positions the seeker head in either an extended, seeking, position or a retracted, cruising, position.

In the seeking position, the seeker head extends out of the missile tip housing so as to provide the seeker head with a preselected, wide, field-of-view. In the cruising position, the seeker head is retracted into the missile tip housing so as to form an aerodynamic continuum with the missile body. The field-of-view of the seeker head in the retracted position, generally suitable for engaging a target after the target has been detected, is narrower than the field-of-view of the seeker head in the extended position.

In a preferred embodiment of the invention, the initial position of the seeker head is the seeking position and the positioner shifts the seeker head to the cruising position after a target has been acquired by the missile. Preferably, the seeker head is shifted to the cruising position only when the missile tracks the acquired target.

BRIEF DESCRIPTION OF THE DRAWINGS

The present invention will be better understood from the following detailed description of a preferred embodiment of the present invention, taken in conjunction with the following drawings in which.

DETAILED DESCRIPTION OF A PREFERRED EMBODIMENT

Figure 1:
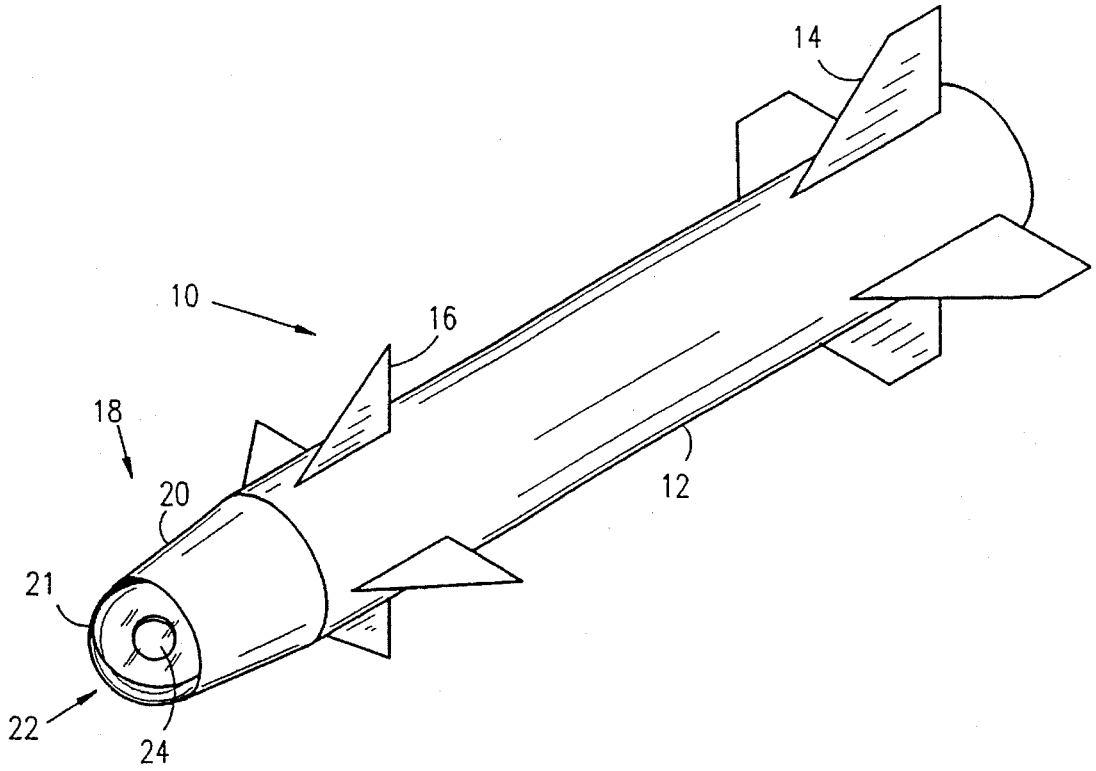
FIG. 1 is a schematic illustration of a missile constructed and operative in accordance with a preferred embodiment of the present invention.

Reference is now made to FIG. 1 which schematically illustrates a missile 10 including a missile body 12 and a missile tip 18. A plurality of fins, indicated by reference numerals 14 and 16, are preferably mounted on missile body 12. Fins 14 and 16 provide missile 10 with improved cruising stability and/or steering capability, as well known in the art.

In accordance with a preferred embodiment of the present invention, missile tip 18 includes a housing 20. A seeker head, also known as a scanner head and referenced generally 22, is preferably mounted into housing 20, as described below with reference to FIGS. 2 and 3. Seeker head 22 includes a scanner 24 which scans a preselected field of view, as described below, preferably through a shield or dome 21. Shield 21 protects scanner 24 from dust, humidity, temperature change or any other undesirable influence of the external environment. Scanner 24 includes an infrared detector, a laser transceiver, or any other active or passive detection apparatus known in the art. If scanner 24 includes an infrared detector, missile 10 preferably includes a cooling system (not shown) for cooling the interior of seeker head 22.

Figures 2A, 2B:
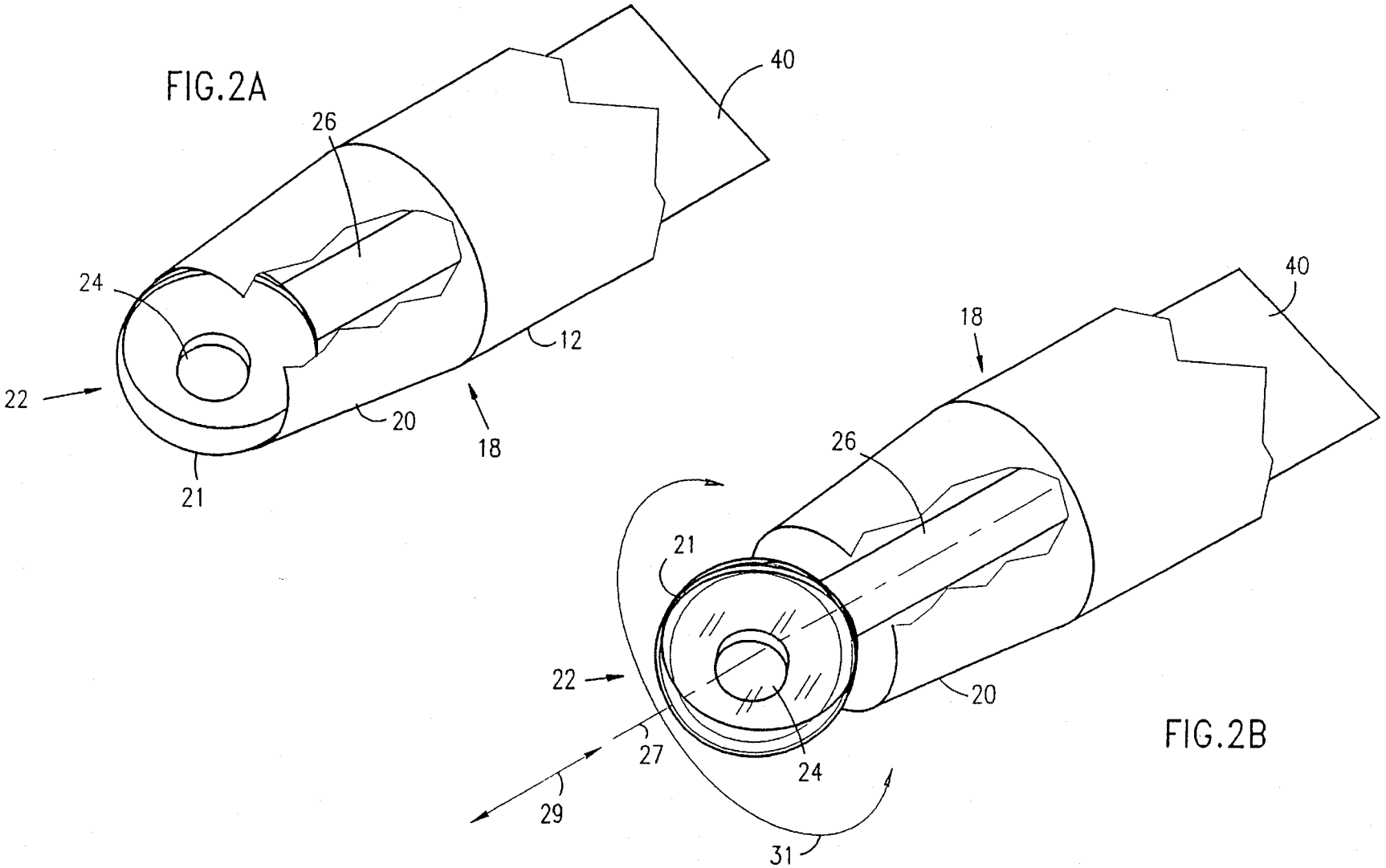
FIG. 2A is a partially cut-away schematic illustration of a tip portion of the missile of FIG. 1, showing a seeker head in a cruising position.
FIG. 2B is a partially cut-away schematic illustration of a tip portion of the missile of FIG. 1, showing a seeker head in a seeking position.
Figure 3B:
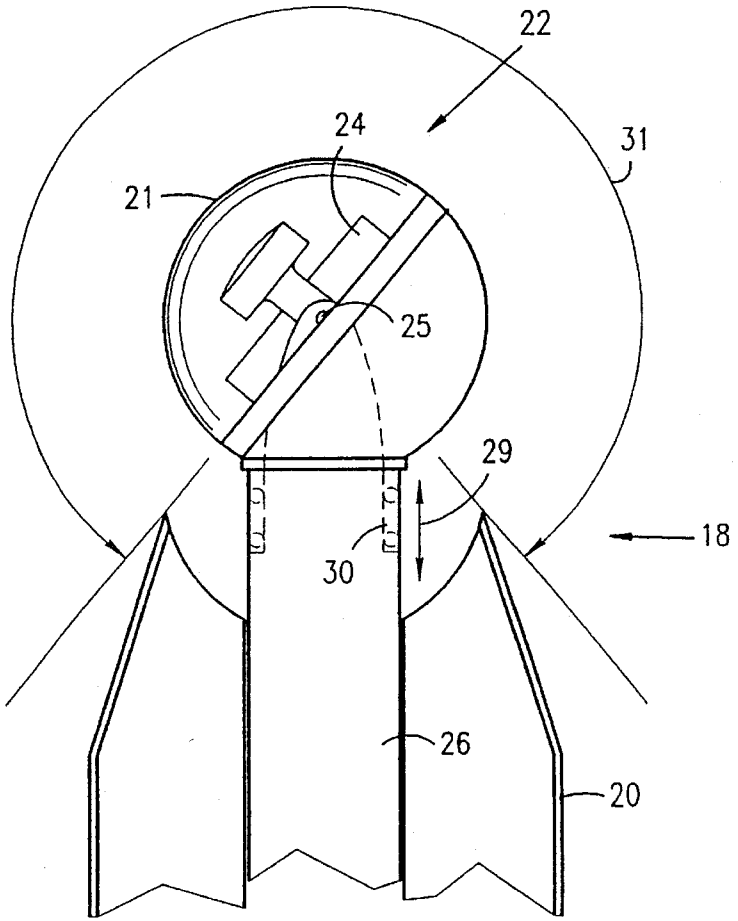
FIG. 3B is a schematic cross sectional illustration of the tip portion of FIG. 2B.
Figure 3A:
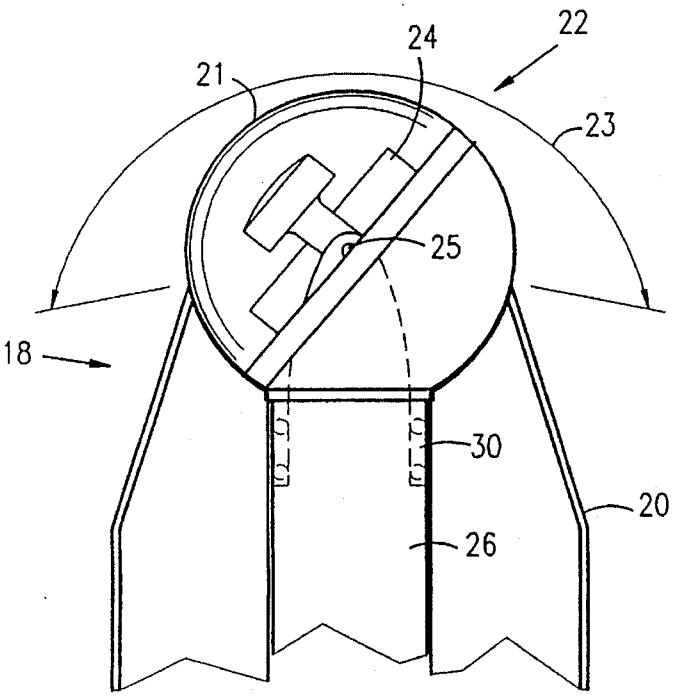
FIG. 3A is a schematic cross sectional illustration of the tip portion of FIG. 2A.

Reference is now made to FIGS. 2A and 2B which are partly cut-away schematic illustrations of missile tip 18, and to FIGS. 3A and 3B which are cross-sectional schematic illustrations of missile tip 18. FIGS. 2B and 3B show seeker head 22 in an extended position, typically used for seeking potential targets, while FIGS. 2A and 3A show seeker head 22 in a retracted position, typically used for cruising toward a detected target. The position of seeker head 22 in FIGS. 2B and 3B will be hereinafter referred to as a seeking position, while the position of seeker head 22 in FIGS. 2A and 3A will be referred to as a cruising position.

Seeker head 22 is preferably mounted on the end of a shaft 26, which is preferably movable along the longitudinal axis 27 of missile 10, as indicated by arrows 29 (FIGS. 2B and 3B). Shaft 26 is preferably also rotatable about axis 27, together with seeker head 22, thereby providing scanner 24 with 360 degree scanning capability about axis 27. Alternatively, seeker head 22 is mounted on shaft 26 by a rotatable mounting 30.

As shown particularly in FIGS. 3A and 3B, scanner 24 is preferably tiltable about a pivot 25 which also connects scanner 24 to shaft 26. While, physically, scanner 24 can be tilted to a very wide field-of-view, the actual field-of-view of scanner 24 depends on the position of seeker head 22 with respect to housing 20. Specifically, it can be seen that the field-of-view of scanner 24 in the cruising position of FIG. 3A, indicated by arrows 23, is considerably narrower than the field-of-view of scanner 24 in the seeking position of FIG. 3B, indicated by arrows 31.

In a preferred embodiment of the present invention, after missile 10 has been launched, seeker head 22 is initially in the seeking position of FIGS. 2B and 3B. This provides scanner 24 with wide field-of-view 31, as described above, thereby raising the probability of scanner 24 to detect a potential target. However, after a target has been acquired by missile 10, wide field-of-view 31 is, normally, no longer required since the general direction of the target has already been located. As missile 10 proceeds to track the target, a considerably narrower scanning field is required and, thus, the seeking position in which seeker 22 extends forward from housing 20 is no longer necessary.

It should be appreciated that the extended seeking position of FIGS. 2B and 3B may result in considerable drag at missile tip 18, particularly at high cruising velocities, thereby reducing the aerodynamic efficiency of missile 10. Thus, in a preferred embodiment of the invention, seeker head 22 is retracted to the cruising position of FIGS. 2A and 3A subsequent to detection of the desired target. It should be appreciated that the cruising position, in which seeker head 22 is partly retracted into housing 20, is aerodynamically superior to the seeking position. Since engagement of the detected target does not require a wide field-of-view, cruising field-of-view 23 may be considerably narrower than seeking field-of-view 31.

In a preferred embodiment of the invention, missile includes a positioner 40 which controls the position of seeker head 22 by controlling the position of shaft 26 along axis 27. In a preferred embodiment of the invention, positioner 40 automatically moves shaft 26 forwards when missile 10 seeks a target and backwards when missile 10 engages a target, i.e. cruises towards a detected target.

It will be appreciated by persons skilled in the art that the present invention is not limited to what has been thus far described. Rather, the scope of the present invention is limited only by the following claims:

I claim:

1. A missile comprising:

a housing mounted inside the tip of the missile;

a seeker head mounted into the housing, the seeker head comprising a scanner mounted on a gimbaled mount; and a positioner which selectably positions the seeker head in either an extended position, wherein the seeker head extends out of the missile tip housing so as to provide the seeker head with a preselected, wide, field-of-view extending to greater than ±90 degrees without requiring compensating optics, or a retracted position, wherein the seeker head is retracted into the missile tip housing so as to form an aerodynamic continuum with the missile body.

2. A missile according to claim 1 wherein the seeker head comprises a scanner tiltable in accordance with a preselected field-of-view.

3. A missile according to claim 1 and further comprising an infrared sensor associated with said seeker head.

4. A missile according to claim 2 and further comprising an infrared sensor associated with said seeker head.

5. A missile according to claim 1 and further comprising a laser transceiver associated with said seeker head.

6. A missile according to claim 2 and further comprising a laser transceiver associated with said seeker head.

7. A missile according to claim 3 and further comprising a laser transceiver associated with said seeker head.

8. A missile according to claim 4 and further comprising a laser transceiver associated with said seeker head.

9. A missile according to claim 1 wherein the positioner positions the seeker head in the extended position when the missile seeks a potential target and wherein the positioner positions the seeker head in the retracted position when the missile cruises toward a detected target.

10. A missile according to claim 2 wherein the positioner positions the seeker head in the extended position when the missile seeks a potential target and wherein the positioner positions the seeker head in the retracted position when the missile cruises toward a detected target.

11. A missile according to claim 3 wherein the positioner positions the seeker head in the extended position when the missile seeks a potential target and wherein the positioner positions the seeker head in the retracted position when the missile cruises toward a detected target.

12. A missile according to claim 5 wherein the positioner positions the seeker head in the extended position when the missile seeks a potential target and wherein the positioner positions the seeker head in the retracted position when the missile cruises toward a detected target.

13. A missile according to claim 1 wherein the seeker head in the retracted position has a preselected, narrow, field-of-view suitable for tracking a target after the target has been acquired by the missile.

14. A missile according to claim 2 wherein the seeker head in the retracted position has a preselected, narrow, field-of-view suitable for tracking a target after the target has been acquired by the missile.

15. A missile according to claim 3 wherein the seeker head in the retracted position has a preselected, narrow, field-of-view suitable for tracking a target after the target has been acquired by the missile.

16. A missile according to claim 5 wherein the seeker head in the retracted position has a preselected, narrow, field-of-view suitable for tracking a target after the target has been acquired by the missile.

17. A missile according to claim 9 wherein the seeker head in the retracted position has a preselected, narrow, field-of-view suitable for tracking a target after the target has been acquired by the missile.

18. A missile according to claim 1 and wherein said preselected, wide, field-of-view extends to approximately ±135 degrees.

19. A missile according to claim 2 and wherein said preselected, wide, field-of-view extends to approximately ±135 degrees.

20. A missile according to claim 3 and wherein said preselected, wide, field-of-view extends to approximately ±135 degrees.

* * * * *